US012330199B2

(12) United States Patent
Hoshino

(10) Patent No.: US 12,330,199 B2
(45) Date of Patent: Jun. 17, 2025

(54) MEANDERING AMOUNT DETECTION METHOD AND MEANDERING CONTROL METHOD FOR METAL STRIP

(71) Applicant: JFE Steel Corporation, Tokyo (JP)

(72) Inventor: Masanori Hoshino, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 213 days.

(21) Appl. No.: 18/034,090

(22) PCT Filed: Jul. 8, 2021

(86) PCT No.: PCT/JP2021/025756
§ 371 (c)(1),
(2) Date: Apr. 27, 2023

(87) PCT Pub. No.: WO2022/091486
PCT Pub. Date: May 5, 2022

(65) Prior Publication Data

US 2023/0390818 A1 Dec. 7, 2023

(30) Foreign Application Priority Data

Oct. 29, 2020 (JP) ..... 2020-181178

(51) Int. Cl.
*B21B 37/68* (2006.01)
*B21B 37/66* (2006.01)
(Continued)

(52) U.S. Cl.
CPC ..... *B21B 37/68* (2013.01); *B21B 38/00* (2013.01)

(58) Field of Classification Search
CPC ..... B21B 37/68; B21B 37/66; B21B 38/00; B21B 39/084; B21B 39/086;
(Continued)

(56) References Cited

U.S. PATENT DOCUMENTS

2015/0306649 A1* 10/2015 Ogata ..... B21C 47/3425 226/104

FOREIGN PATENT DOCUMENTS

DE 10 2014 215 397 A1 2/2016
EP 2 283 942 A1 2/2011
(Continued)

OTHER PUBLICATIONS

English translate (JP2012223771A), retrieved date Jan. 19, 2025.*
(Continued)

*Primary Examiner* — Mohammed S. Alawadi
(74) *Attorney, Agent, or Firm* — DLA Piper LLP (US)

(57) ABSTRACT

A meandering amount detection method for a metal strip traveling in a state of being overlapped in a plurality of stages, includes: calculating an end portion position in a width direction of a metal strip in each stage using an angle formed by a reference direction, which is any direction determined from a reference point, and a direction connecting the reference point and an end portion position in a width direction of a metal strip in each stage, a distance between the reference point and an end portion position in a width direction of a metal strip in each stage, and a distance between a straight line including a width direction of the metal strip and the reference point; and calculating a meandering amount of a metal strip in each stage based on the calculated end portion position in the width direction of the metal strip in each stage.

4 Claims, 2 Drawing Sheets

(51) Int. Cl.

| | |
|---|---|
| ***B21B 38/00*** | (2006.01) |
| ***B21B 39/08*** | (2006.01) |
| ***B21C 47/34*** | (2006.01) |
| ***B21C 49/00*** | (2006.01) |
| ***B21C 51/00*** | (2006.01) |

(58) Field of Classification Search
CPC ..... B21B 2273/04; B21C 47/3425; B21C 51/00; B21C 49/00
See application file for complete search history.

(56) References Cited

FOREIGN PATENT DOCUMENTS

| | | | | | |
|---|---|---|---|---|---|
| EP | 3 100 793 | A1 | | 12/2016 | |
| JP | S63-221208 | A | | 9/1988 | |
| JP | 2005334949 | A | * | 12/2005 | |
| JP | 2012223771 | | * | 12/2005 | ..... B21B 38/00 |
| JP | 2006-346715 | A | | 12/2006 | |
| JP | 2012-223771 | A | | 11/2012 | |
| JP | 2013-019098 | A | | 5/2013 | |
| JP | 2013091098 | A | * | 5/2013 | |
| JP | 2014-231432 | A | | 12/2014 | |
| JP | 2017-192943 | A | | 10/2017 | |

OTHER PUBLICATIONS

English translate (JP2005334949A), retrieved date Jan. 19, 2025.*
English translate (JP2013091098A), retrieved date Jan. 19, 2025.*
Extended European Search Report dated Feb. 13, 2024, of counterpart European Patent Application No. 21885609.4.
International Search Report dated Aug. 10, 2021 in counterpart International Application No. PCT/JP2021/025756 w/English translation.
Written Opinion dated Aug. 10, 2021 in counterpart International Application No. PCT/JP2021/025756.

* cited by examiner

POINTS A, B, C, AND D EACH ARE PLATE END POSITIONS (E.G.) IF $\theta$=0 IS TAKEN PERPENDICULAR TO GROUND, PLATE END POSITION $(h\text{-}h_1)tan\theta_1$

MEANDERING AMOUNT DETECTION METHOD AND MEANDERING CONTROL METHOD FOR METAL STRIP

TECHNICAL FIELD

This disclosure relates to a meandering amount detection method and a meandering control method for a metal strip.

BACKGROUND

In general, a treatment line for a metal strip such as a steel plate is constituted of an entry side section for performing delivery, welding and others of the metal strip, a central section for performing annealing, rolling, pickling and others on the metal strip, and an exit side section for performing winding and cutting of the metal strip. Each of the sections is provided with a plurality of rolls for performing support of plate passing, tension control, and others, and a metal strip passes over the rolls and undergoes a series of processes from the entry side to the exit side. This series of processes is referred to as plate passing.

To keep the quality of a metal strip constant by making the plate passing speed in the central section constant, a storing and delivering device for a metal strip called a looper is provided between each of the entry side section, the central section, and the exit side section. The looper includes a fixed roll and a looper car, and the further the looper car is from the fixed roll, the more a metal strip is stored. Typically, to increase the storage amount of a metal strip, the looper is in a state in which a metal strip is overlapped in a plurality of stages at intervals in the longitudinal direction or the lateral direction.

A metal strip may be displaced from the center position in the width direction of the roll toward the end portion in the width direction during plate passing due to factors such as wear of the roll and the shape of the metal strip. This phenomenon is called meandering. When the meandering amount of a metal strip increases, there is a possibility that equipment may be damaged due to contact between the metal strip and peripheral equipment or the metal strip may be broken due to a sudden change in tension, and there is a concern about a significant production loss. In view of such a background, a technique for controlling a meandering amount of a metal strip has been proposed.

Specifically, a center position control (CPC) device is known as a general meandering control device, and the CPC device includes a meandering detector and a meandering correction operation mechanism (hereinafter referred to as a steering roll). Examples of the meandering detector include a pair of a light projector and a light receiver, and an automatic width control (AWC), and examples of the meandering correction operation mechanism include a roll tilting mechanism. The meandering detector detects a width-direction position of a metal strip. The CPC device calculates a deviation between a detection value of the meandering detector and a target position, and operates to reduce the deviation by controlling the meandering correction operation mechanism.

JP 2014-231432 A describes a method of improving a meandering correction capability by reducing a tension of a steel plate in a looper with respect to a function of detecting the meandering of the steel plate using a light projector and correcting the meandering of the steel plate by tilting a steering roll. JP 2006-346715 A describes a device and a method in which split rolls are provided in the width direction of a steel plate, reaction forces from the steel plate acting on both end portions of the split rolls are detected, and the meandering amount of the steel plate is calculated.

However, a looper car travels in a looper, and it is not possible to install devices such as a light projector and receiver and an AWC in a traveling passage of the looper car. Therefore, it is difficult to perform meandering control of a metal strip in the looper using a CPC device. On the other hand, in the method described in JP '432, since a light projector is used, there is a restriction that the meandering of the metal strip on the fixed roll side can only be detected. In the method described in JP '715, a large number of devices such as a split roll, a support shaft, and a pressure detector are required, which increases the installation space and the cost for the devices.

It could therefore be helpful to provide a meandering amount detection method for a metal strip, which is capable of detecting a meandering amount of a metal strip in a looper, in any stage, in a space-saving and cost-saving manner, as well as a meandering control method for a metal strip capable of detecting a meandering amount of a metal strip in a looper, in any stage, in a space-saving and cost-saving manner and correcting the meandering of the metal strip.

SUMMARY

We provide a meandering amount detection method for a metal strip is a method that detects a meandering amount of a metal strip traveling in a state of being overlapped in a plurality of stages at intervals, the meandering amount detection method including: a first step of calculating an end portion position in a width direction of a metal strip in each stage using an angle formed by a reference direction, which is any direction determined from a reference point, and a direction connecting the reference point and an end portion position in a width direction of a metal strip in each stage, a distance between the reference point and an end portion position in a width direction of a metal strip in each stage, and a distance between a straight line including a width direction of the metal strip and the reference point; and a second step of calculating a meandering amount of a metal strip in each stage based on the end portion position in the width direction calculated in the first step.

Moreover, in the meandering amount detection method for a metal strip, the first step includes a step of causing a distance meter to scan about the reference point and setting a scan angle at which a detection value suddenly changes from a relationship between a scan angle and a detection value of a distance meter as an angle formed by the reference direction and a direction connecting the reference point and an end portion position in a width direction of a metal strip in each stage.

Moreover, a meandering control method for a metal strip includes a step of controlling meandering of a metal strip based on a meandering amount of a metal strip detected by using the meandering amount detection method for the metal strip.

My meandering amount detection method for a metal strip can detect a meandering amount of a metal strip in a looper, in any stage, in a space-saving and cost-saving manner. According to the meandering control method for a metal strip, the meandering amount of the metal strip in the looper can be detected in any stage in a space-saving and cost-saving manner, and the meandering of the metal strip can be corrected.

REFERENCE SIGNS LIST

1 LOOPER
2, 2*a*, 2*b*, 2*c*, 2*d* METAL STRIP
3 STEERING ROLL
4 LOOPER CAR
10 MEANDERING CONTROL DEVICE FOR METAL STRIP
11 DISTANCE METER (REFERENCE POINT)
12 MEANDERING DETECTOR
13 CONTROL DEVICE

DETAILED DESCRIPTION

A configuration of a meandering control device for a metal strip, which is an example, will be described below with reference to the drawings.

Configuration of Looper

A configuration of a looper to which a meandering control device for a metal strip, which is an example, is applied will be first described with reference to FIG. 1.

Figure 1:
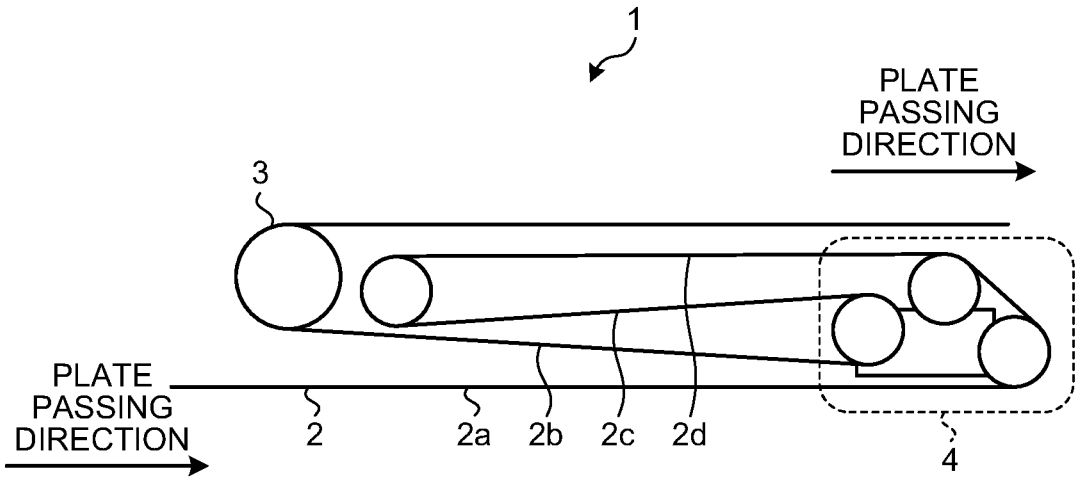
FIG. 1 is a side view illustrating a configuration of a looper to which a meandering control device for a metal strip, which is an example, is applied.

FIG. 1 is a side view illustrating a configuration of a looper to which a meandering control device for a metal strip is applied. As illustrated in FIG. 1, in a looper 1 to which a meandering control device for a metal strip is applied, a metal strip 2 is passed through to reciprocate between a steering roll 3 and a looper car 4. Therefore, metal strips 2 (2*a*, 2*b*, 2*c*, and 2*d*) in a plurality of stages are present at intervals in the looper 1. In this example, the meandering control device for a metal strip detects the meandering amount of the metal strip 2 in the looper 1, in any stage, in a space-saving and cost-saving manner, and corrects the meandering of the metal strip 2.

Configuration of Meandering Control Device for Metal Strip

A configuration of a meandering control device for a metal strip, which is an example, will now be described with reference to FIGS. 2 and 3.

Figure 2:
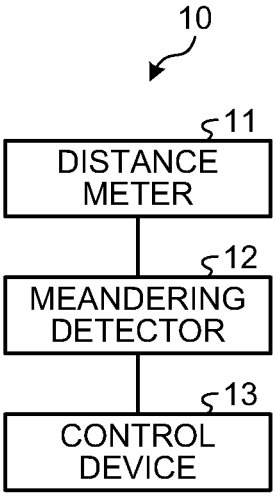
FIG. 2 is a block diagram illustrating a configuration of a meandering control device for a metal strip, which is an example.

FIG. 2 is a block diagram illustrating a configuration of a meandering control device for a metal strip, which is an example. As illustrated in FIG. 2, a meandering control device 10 for a metal strip includes a distance meter 11, a meandering detector 12, and a control device 13.

Figure 3:
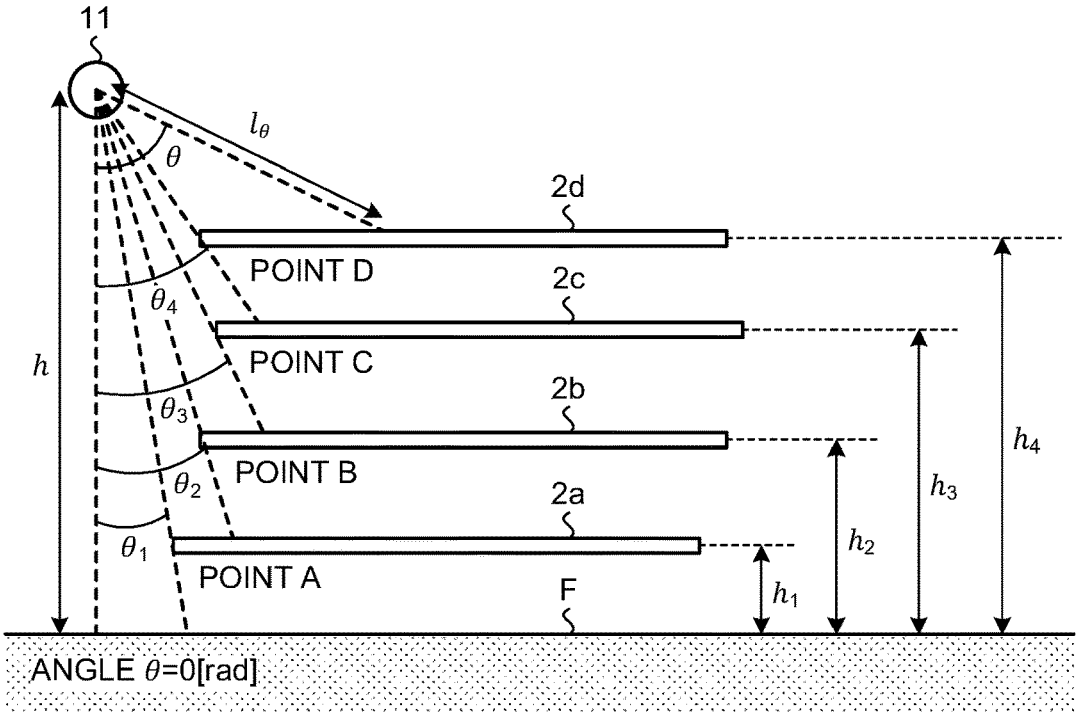
FIG. 3 is a diagram for explaining parameters detected by a distance meter illustrated in FIG. 2.

As illustrated in FIG. 3, the distance meter 11 is constituted of a two-dimensional scanner (two-dimensional distance sensor) provided on the upper side of the metal strip 2 in the uppermost stage and on one side of the end portion in the width direction of the metal strip 2. The distance meter 11 detects values of parameters $\theta$, $\theta_i$, and $l_\theta$ by scanning a range of a predetermined angle, and outputs an electric signal indicating the detected values to the meandering detector 12. The position of the distance meter 11 is set as a reference point, and the lower side in the vertical direction of the distance meter 11 is set as a reference direction. The parameter $\theta$ represents an angle (>0) from the scan start direction (the reference direction) of the distance meter 11, the parameter $\theta_i$ represents an angle (an angle formed by the reference direction and a direction connecting the reference point and an end portion position in the width direction of the metal strip in each stage) when end surfaces (points A to D) of the metal strip 2 in the i-th stage (i=1 to 4 in this example) is detected, a parameter h represents a height of the installation position of the distance meter 11 from a ground F, a parameter $h_i$ represents a height of the metal strip 2 in the i-th stage from the ground F, and the parameter $l_\theta$ represents a measurement value of the distance meter 11 at the angle $\theta$ (a distance between the reference point and an end portion position in the width direction of the metal strip in each stage). Note that, in the above description, $h-h_i$ is a distance between a straight line including the width direction of the metal strip and the reference point (a length of a perpendicular line from the reference point to the straight line).

The distance meter 11 may be constituted of a combination of a three-dimensional scanner and a plurality of one-dimensional distance meters. The installation position of the distance meter 11 is not necessarily on the upper side of the metal strip 2 in the uppermost stage. By installing the distance meter 11 not only on one side of the end portion in the width direction of the metal strip 2, but also on the other end portion side, improvement of detection accuracy and a backup function at the time of a failure may be realized.

Figure 4:
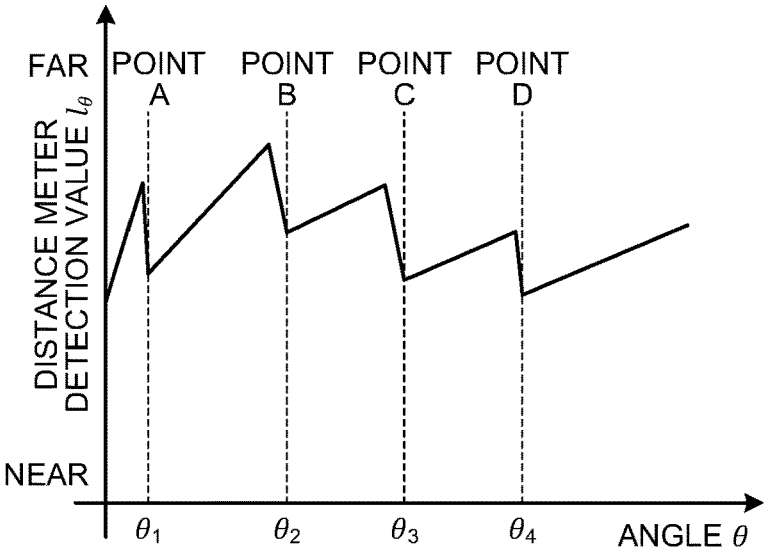
FIG. 4 is a diagram illustrating the relationship between a scan angle and a detection value of the distance meter.

The meandering detector 12 detects a meandering amount $s_i$ of the metal strip 2 in the i-th stage based on the electric signal output from the distance meter 11, and outputs an electric signal indicating the detected meandering amount $s_i$ to the control device 13. Specifically, when the distance meter 11 is caused to scan in a direction in which the angle $\theta$ increases from 0, the measurement value $l_\theta$ of the distance meter 11 greatly decreases at the end surfaces (the points A to D) of the metal strip 2, as illustrated in FIG. 4. The change in the measurement value $l_\theta$ is expressed by Equations (1) and (2). In the equations, $l_{\theta_i}$ represents the measurement value $l_\theta$ of the distance meter 11 corresponding to the end surface of the metal strip 2 in the i-th stage.

$$\text{Immediately Before End Surface Detection: } l_{\theta_i} = \lim_{a \to -0} l_{\theta_i + a} = h/\cos\theta_i \quad (1)$$

$$\text{Immediately After End Surface Detection: } l_{\theta_i} = \lim_{a \to +0} l_{\theta_i + a} = (h - h_i)/\cos\theta_i \quad (2)$$

Therefore, the meandering detector 12 detects a meandering amount of the metal strip 2 in the i-th stage based on the angle $\theta_i$ at the time when the measurement value $l_\theta$ of the distance meter 11 suddenly changes. In other words, assuming that the angle $\theta_i$ when the meandering amount of the metal strip 2 in the i-th stage is 0 is $\theta_{a0}$, the meandering detector 12 calculates a meandering amount $s_i$ of the metal strip 2 in the i-th stage by Equation (3). In Equation (3), $l_{\theta_{a0}}$ represents the measurement value $l_\theta$ of the distance meter 11 when the meandering amount of the metal strip 2 in the i-th stage is 0.

$$s_i = l_{\theta_{a0}}\sin\theta_{a0} - l_{\theta_i}\sin\theta_i \quad (3)$$
$$= (h - h_i)\sin\theta_{a0}/\cos\theta_{a0} - (h - h_i)\sin\theta_i/\cos\theta_i$$
$$= (h - h_i)\tan\theta_{a0} - (h - h_i)\tan\theta_i$$
$$= (h - h_i)(\tan\theta_{a0} - \tan\theta_i)$$

The control device 13 performs control so that the meandering amount $s_i$ of the metal strip 2 in the i-th stage detected by the meandering detector 12 falls within a predetermined range. Specifically, the control device 13 corrects the meandering of the metal strip 2 in the i-th stage by tilting the steering roll directly connected to the metal strip 2 in the i-th stage.

As is apparent from the above description, in the meandering control device 10 for a metal strip, the meandering detector 11 calculates the end portion position in the width direction of the metal strip 2 in each stage using the heights h and $h_i$, the angle $\theta_i$, and the measurement value $l_\theta$ of the distance meter 11, and calculates the meandering amount $s_i$ of the metal strip 2 in each stage based on the calculated end portion position in the width direction so that the meandering amount of the metal strip 2 in the looper 1 can be detected in any stage in a space-saving and cost-saving manner.

Although the example applied has been described above, this disclosure is not limited by the description and the drawings constituting a part of the disclosure according to the example. For example, since my methods are characterized by being used in a place where metal strips are overlapped in a plurality of stages, they can also be applied to a place other than a looper (e.g., the vicinity of a joining portion of metal strips when a plurality of metal strip delivery devices is provided). As described above, other examples, operation techniques, and others implemented by those skilled in the art and others based on this example are all included in the scope of the disclosure.

INDUSTRIAL APPLICABILITY

I make it possible to provide a meandering amount detection method for a metal strip, which is capable of detecting a meandering amount of a metal strip in a looper, in any stage, in a space-saving and cost-saving manner. It is possible to provide a meandering control method for a metal strip capable of detecting a meandering amount of a metal strip in a looper, in any stage, in a space-saving and cost-saving manner and correcting the meandering of the metal strip.

The invention claimed is:

1. A meandering amount detection method for detecting a meandering amount of a metal strip traveling in a state of being overlapped in a plurality of stages at intervals, the method comprising:

calculating an end portion position in a width direction of the metal strip in each of the plurality of stages using an angle formed by a reference direction, wherein the reference direction is determined from a reference point, and a direction connecting the reference point and the end portion position in the width direction of the metal strip in each of the plurality of stages, a distance between the reference point and the end portion position in the width direction of the metal strip in each of the plurality of stages, a distance between a straight line including the width direction of the metal strip and the reference point; and calculating the meandering amount of the metal strip in each of the plurality of stages based on the calculated end portion position in the width direction of the metal strip in each of the plurality of stages.

2. The meandering amount detection method for detecting the meandering amount of the metal strip according to claim 1, wherein the calculating the end portion position in the width direction of the metal strip in each of the plurality of stages includes causing a distance meter to scan about the reference point, and setting a scan angle at which a detection value suddenly changes from a relationship between the scan angle and the detection value of the distance meter as an angle formed by the reference direction and the direction connecting the reference point and the end portion position in the width direction of the metal strip in each of the plurality of stages.

3. A meandering control method for the metal strip, comprising:

detecting the meandering amount of the metal strip by using the meandering amount detection method for detecting the meandering amount of the metal strip according to claim 2; and controlling the meandering of the metal strip based on the meandering amount of the metal strip.

4. A meandering control method for the metal strip, comprising:

detecting the meandering amount of the metal strip by using the meandering amount detection method for detecting the meandering amount of the metal strip according to claim 1; and controlling the meandering of the metal strip based on the meandering amount of the metal strip.

* * * * *